US009660315B2

(12) United States Patent
Baldwin et al.

(10) Patent No.: US 9,660,315 B2
(45) Date of Patent: May 23, 2017

(54) GROUND STRUCTURES BETWEEN RESONATORS FOR DISTRIBUTED ELECTROMAGNETIC WAVE FILTERS

(71) Applicant: RAYTHEON COMPANY, Waltham, MA (US)

(72) Inventors: Jeremy B. Baldwin, Sahuarita, AZ (US); Kevin W. Patrick, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 84 days.

(21) Appl. No.: 14/735,673

(22) Filed: Jun. 10, 2015

(65) Prior Publication Data

US 2016/0365616 A1 Dec. 15, 2016

(51) Int. Cl.

| | |
|---|---|
| ***H01P 1/203*** | (2006.01) |
| ***H01P 7/08*** | (2006.01) |
| ***H01P 3/08*** | (2006.01) |

(52) U.S. Cl.

CPC ..... *H01P 1/20327* (2013.01); *H01P 3/08* (2013.01); *H01P 3/082* (2013.01); *H01P 7/082* (2013.01)

(58) Field of Classification Search

CPC .. H01P 1/203; H01P 3/08; H01P 3/082; H01P 1/20327; H01P 7/082

USPC ..... 333/204, 238, 246

See application file for complete search history.

(56) References Cited

U.S. PATENT DOCUMENTS 6,396,264 B1 * 5/2002 Tamaki ..... G01R 33/0322 324/244.1

2011/0227673 A1 9/2011 Patrick et al.

* cited by examiner

*Primary Examiner* — Stephen E Jones
*Assistant Examiner* — Rakesh Patel
(74) *Attorney, Agent, or Firm* — Lewis Roca Rothgerber Christie LLP

(57) ABSTRACT

A distributed electromagnetic (EM) wave filter includes: a cavity; upper and lower ground planes on top and bottom surfaces of the cavity, wherein the upper and lower ground planes are in electrical contact; a plurality of electromagnetically coupled resonators in said cavity between the upper and lower ground planes that define respective transmission lines, wherein the plurality of resonators are not connected to each other by a conductive connection; an input port coupled to a first one of the plurality of resonators to receive an EM wave; an output port coupled to a last one of the plurality of resonators to output a filtered EM wave; and a plurality of conductive structures between adjacent resonators, respectively and connected to one or more of the upper and lower ground planes.

11 Claims, 9 Drawing Sheets

GROUND STRUCTURES BETWEEN RESONATORS FOR DISTRIBUTED ELECTROMAGNETIC WAVE FILTERS

FIELD OF THE INVENTION

This invention generally relates to distributed electromagnetic wave filters and more particularly to ground structures formed between electromagnetically coupled resonators for planar and folded distributed electromagnetic wave filters.

BACKGROUND

A distributed element filter is an electromagnetic (EM) wave filter designed for frequencies between approximately 100 MHz to approximately 100 GHz and more typically between 500 MHz and 60 GHz. These bands may be referred to as RF or microwave bands. At these frequencies, the physical length of passive components is a significant fraction of the wavelength of the operating frequency, and it becomes difficult to use the conventional lumped element model. The distributed element model allows these components to be designed using transmission line theory better suited for these frequencies. These filters may be configured as low-pass, high-pass, band-pass or band-stop filters. The filter is made up of one or more coupled resonators. A resonator oscillates at some frequency, called its resonance frequency, with greater amplitude than others.

Selection of the number and design of individual resonators determines the nature of the filter response. The resonators may be grounded at either or both ends or left open. The wave may be coupled from one resonator to the next by direct-coupling in which a transmission line directly connects one resonator to the next or by parallel coupling in which the waves are coupled through the dielectric media (air or some other dielectric). The wave may be coupled into and out of the filter by any suitable means including direct-coupling or capacitive coupling. The filter may be configured in any one of many different topologies including, but not limited to, interdigital, comb-line, parallel-coupled line, hairpin parallel coupled line, short circuited quarter-wave stub band pass, open circuited quarter-wave stub band stop.

The filter may be configured as a microstrip or a stripline. A microstrip is made up of a conducting strip (the "resonator") separated from a ground plane by a dielectric layer (air or a dielectric material). A stripline is made up of a conducting strip (the "resonator") sandwiched between parallel ground planes separated by a dielectric (air or dielectric material). The conducting strip is typically but need not be equally spaced between the ground planes. The dielectric layer typically exhibits a uniform dielectric constant but may vary. The dimensions of the resonators and the cavity are on the order of the wavelength of the EM wave applied to and modified by the filter. For example, the resonators may have a length of one-quarter or one-half the center frequency wavelength ($\lambda$).

FIGS. 1*a* through 1*c* illustrate an embodiment of a 5-pole stripline band-pass filter 10. Four ¼$\lambda$ planar resonators 12*a* through 12*e* lie in a dielectric layer 14 equally spaced between an upper ground plane 16 and a lower ground plane 18 that define a cavity 20. In this embodiment each resonator has a length "l" and a width "w". The length "l" generally determines the center frequency of the filter and the width "w" (and thickness) generally determine the impedance. The resonators are connected to ground at one end to a side ground plane 21 and open at the other end. The cavity has a width "a" which is the resonator length "l" plus any additional unoccupied space and a length 's' which is the center-to-center spacing of the resonators. This spacing generally determines coupling of the electric field E 22 and the magnetic field M 24 (jointly referred to as electromagnetic fields) between resonators. An electromagnetic wave 26 is coupled into the filter via an input 28 and is parallel-coupled from one resonator to the next and is coupled out of the filter as filtered wave 30 via an output 32. The propagation of the wave from one resonator to the next filters the wave according to the designed filter response (e.g. low-pass, high-pass, band-pass or band-stop).

However, the total filter response also includes undesirable components due to the coupling of the propagating wave between non-adjacent resonators and due to the propagating of the wave down the waveguide formed by the cavity and external ground planes. For an electromagnetic wave to propagate down a rectangular cross-section shaped cavity with minimal attenuation, the cavity has to be at least a half wavelength wide. If the cavity is less than a half wavelength wide, the wave will still propagate down the cavity but it will be attenuated according to $\alpha=(L*27.2875/a)*SQRT(1-\in_r*(2*a/\lambda_0)^2)$ dB where $\alpha$ is the attenuation for a given length L of transmission line or cavity, L is the length of the transmission line or cavity, $\lambda_0$ is the wavelength of the wave, $\in_r$ is the relative dielectric constant of the dielectric material in the cavity and a is the cavity width. For a given filter design the cavity width "a" may be such that the attenuation of the wave travelling down the waveguide and the attenuation of the wave coupled between non-adjacent resonators is not sufficient to effectively eliminate these components from the total filter response. Standard filter design tools assume these undesirable components are zero. Therefore, their existence not only affects the filter response in a negative manner but also in a manner not predicted by the design.

FIG. 2 illustrates the same 5-pole band-pass stripline filter in a folded resonator configuration. Resonator 12*a* (and each of the resonators) is folded in a plane normal to the upper and lower ground planes 16 and 18. An internal ground plane 34 suitably separates the upper and lower planar segments 36 and 38 of resonator 12*a*, which are connected by a vertical segment 40. The cavity width "a" is largely unaffected as it determined primarily by the unfolded length "l" of resonator 12*a*. Folding of the resonators is done to reduce the overall footprint of the filter.

Folding however negatively affects the performance of the filter since the vertical segment serves to better stimulate the propagation of the EM wave through the waveguide structure. This, in turn, increases the undesirable components attributable to waveguide propagation and coupling between non-adjacent resonators.

A co-owned U.S. Pub. No. 2011/0227673 now, U.S. Pat. No. 8,258,897, describes a ground structure in the resonators by forming one or more holes in one or more of the resonators and passing a conductive structure through each hole normal to the resonator to reduce the coupling between non-adjacent resonators and wave propagation through the waveguide structure. The achieved filter response is attributable to the desired coupling between adjacent resonators. There are no conductive structures between the electromagnetically coupled resonators, because placement of conductive structures between the resonators blocks the coupling of electric and magnetic fields between the adjacent resonators and therefore substantially reduces the performance of the filter. Since the only coupling between the adjacent resonators is the electromagnetic coupling (the resonators are not physically connected together by a conductive connection), any placement of conductive structures between the resonators is generally counter intuitive because of the degradation of the performance. In a direct-coupled filter topology (that is, a topology where the resonators are physically connected together by a conductive line, such as a transmission line), additional conductive structures may be placed between the resonators to effectively reduce the resonator cavity width so that the filter response is determined by the directly coupled wave.

However, in many cases, due to size (width) limitation of the resonators, grounding cannot be done in the resonators, that is, the electromagnetically coupled resonators may be too narrow to accommodate any conductive structure in them.

SUMMARY

In contrast to the prior art structures, the present invention places ground structures, such as, ground via contacts (vias) between the electromagnetically coupled resonators that are not physically connected together by a conductive connection. As described above, this results in degradation of the filter performance due to reduction in coupling of the resonators. However, the present invention, places the adjacent resonators closer to each other to remedy the reduction of the coupling of electromagnetic field between the adjacent resonators. This novel structure provides grounding between the input and output of the filter and thus reduces the coupling from the input to the output.

In some embodiments, the invention is a distributed electromagnetic (EM) wave filter including: a cavity; upper and lower ground planes on top and bottom surfaces of the cavity, wherein the upper and lower ground planes are in electrical contact; a plurality of electromagnetically coupled resonators in said cavity between the upper and lower ground planes that define respective transmission lines, wherein the plurality of resonators are not connected to each other by a conductive connection; an input port coupled to a first one of the plurality of resonators to receive an EM wave; an output port coupled to a last one of the plurality of resonators to output a filtered EM wave; and a plurality of conductive structures between adjacent resonators, respectively and connected to one or more of the upper and lower ground planes.

The plurality of conductive structures may be formed in a single row, multi-row or non-row configuration. Each of the plurality of resonators may be a planar resonator parallel to the upper and lower ground planes, or a folded resonator normal to the upper and lower ground planes. The conductive structures may be via contacts, screws, metal or wire pieces, and the like.

In some embodiments, the plurality of resonators are spaced apart from said lower ground plane to define a micro-strip transmission line. In some embodiments, the plurality of resonators are approximately equidistance from said upper and lower ground planes within a dielectric media of uniform dielectric constant to define a stripline transmission line.

DETAILED DESCRIPTION

In some embodiments, the present invention is a distributed electromagnetic wave filter with reduced coupling between input and output, and reduced wave propagation through the waveguide structure. The filter includes one or more conductive structures, such as vias between one or more of the adjacent electromagnetically coupled resonators (planar or folded). The conductive structures (vertical vias or horizontal strips) are grounded, by connection to one or more ground planes, capacitive coupling to a ground plane or by creation of a virtual ground. In some embodiments, the conductive structures are placed between each adjacent pair of coupled resonators, while in other embodiments, the conductive structures are placed between only a portion of the adjacent pair of coupled resonators.

However, the conductive structures have an adverse effect on the coupling between adjacent resonators and the desired filter response, where the resonators are not connected to each other by a conductive connection. The elimination or substantial reduction of undesired (and undesigned for) waveguide propagation and coupling between the input and the output improves the actual filter response and closely matches the actual filter response to the designed filter response.

Those skilled in the art would appreciate that the proposed conductive structures between the individual resonators are generally applicable to any distributed element EM wave filter regardless of the transmission line (microstrip or stripline), I/O configuration, coupling between resonators (parallel or direct), resonator geometry (planar or folded), resonator topology (interdigital, comb-line, etc.) or filter response (band-pass, band-stop, low-pass or high-pass). The number and placement of the conductive structures depends on the requirements and specifics of a particular filter design.

Figure 1A:
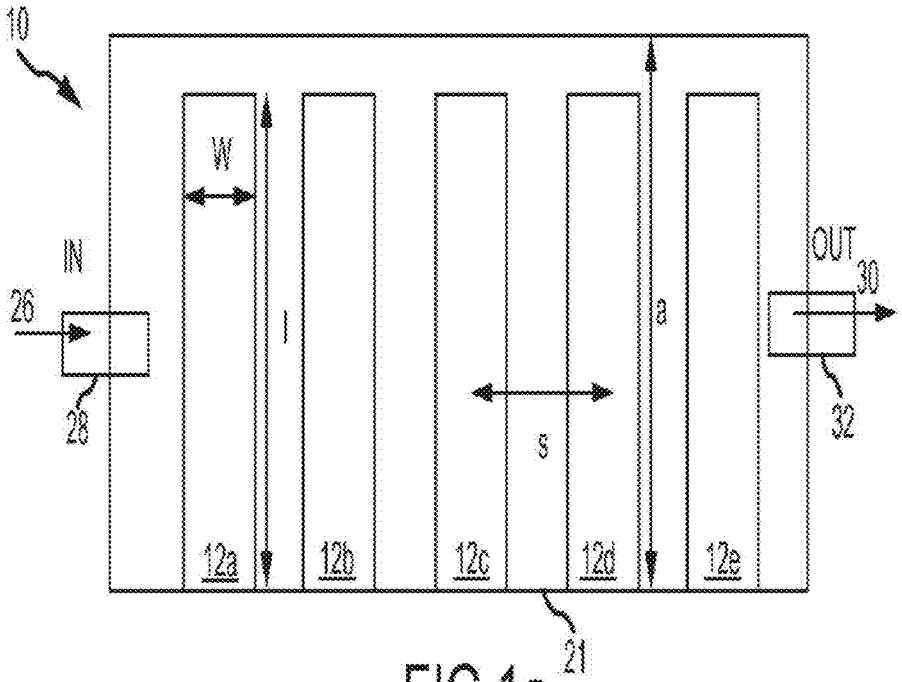
FIG.1a (PRIOR ART)
FIGS. 1*a* to 1*c* are plan, end and side views of a conventional 5-pole stripline band-pass filter with planar resonators.
Figure 1B:
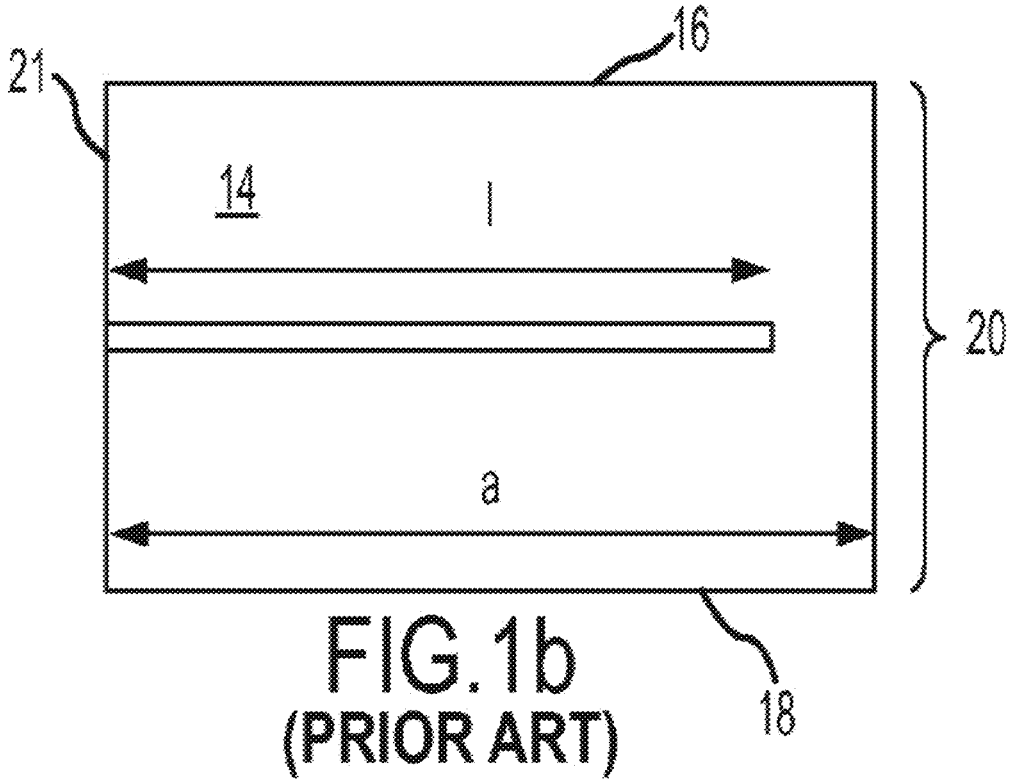
FIG.1b (PRIOR ART)
Figure 1C:
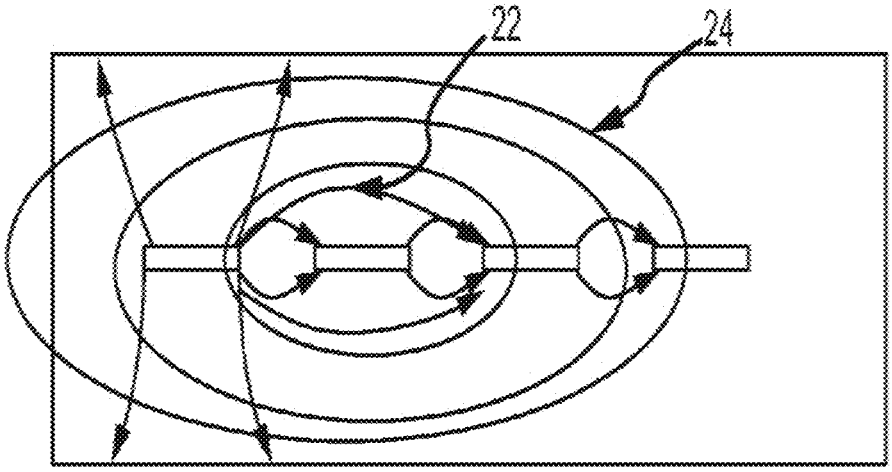
FIG.1c (PRIOR ART)
Figure 2:
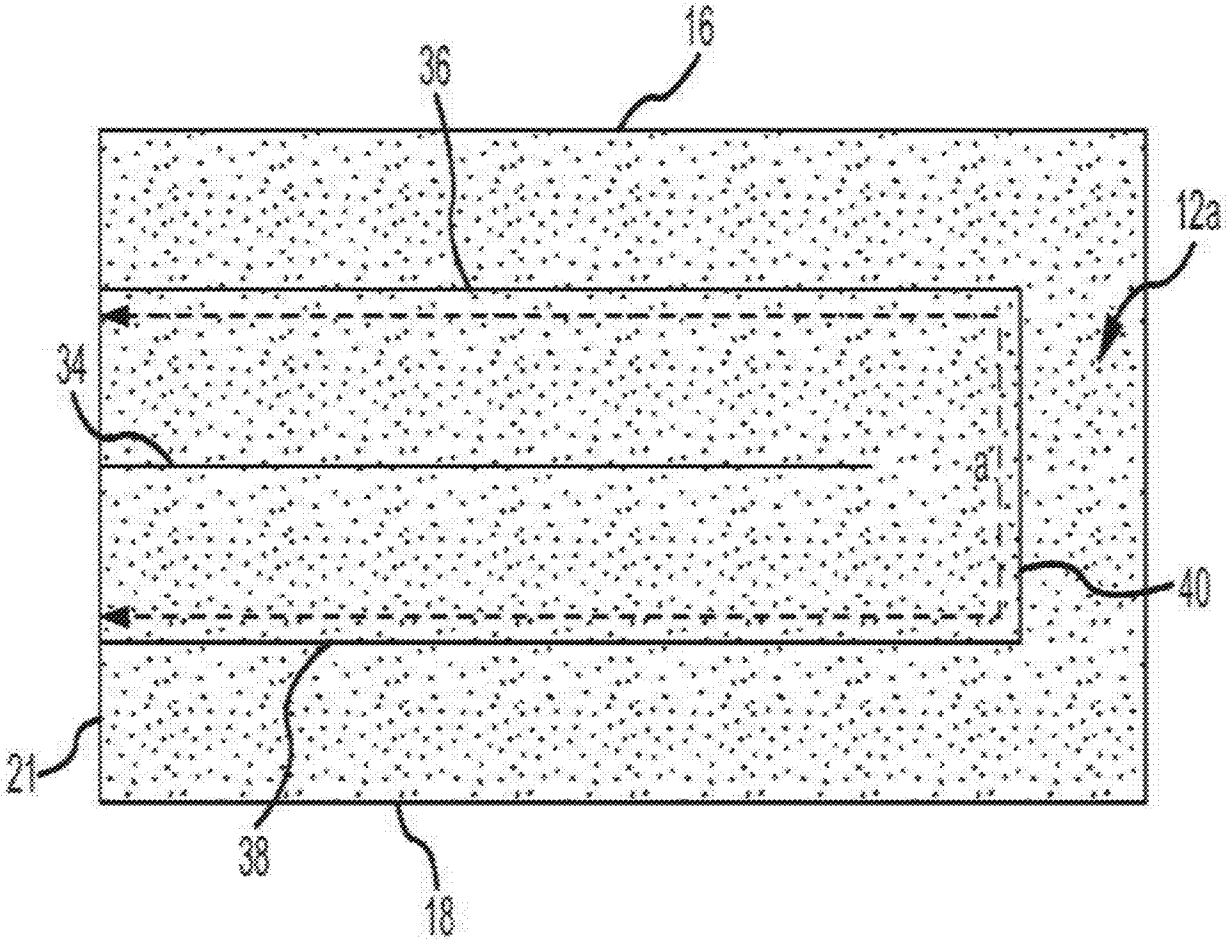
FIG.2 (PRIOR ART)
FIG. 2 is an end view of a conventional 5-pole stripline band-pass filter with folded resonators.
Figure 3A:
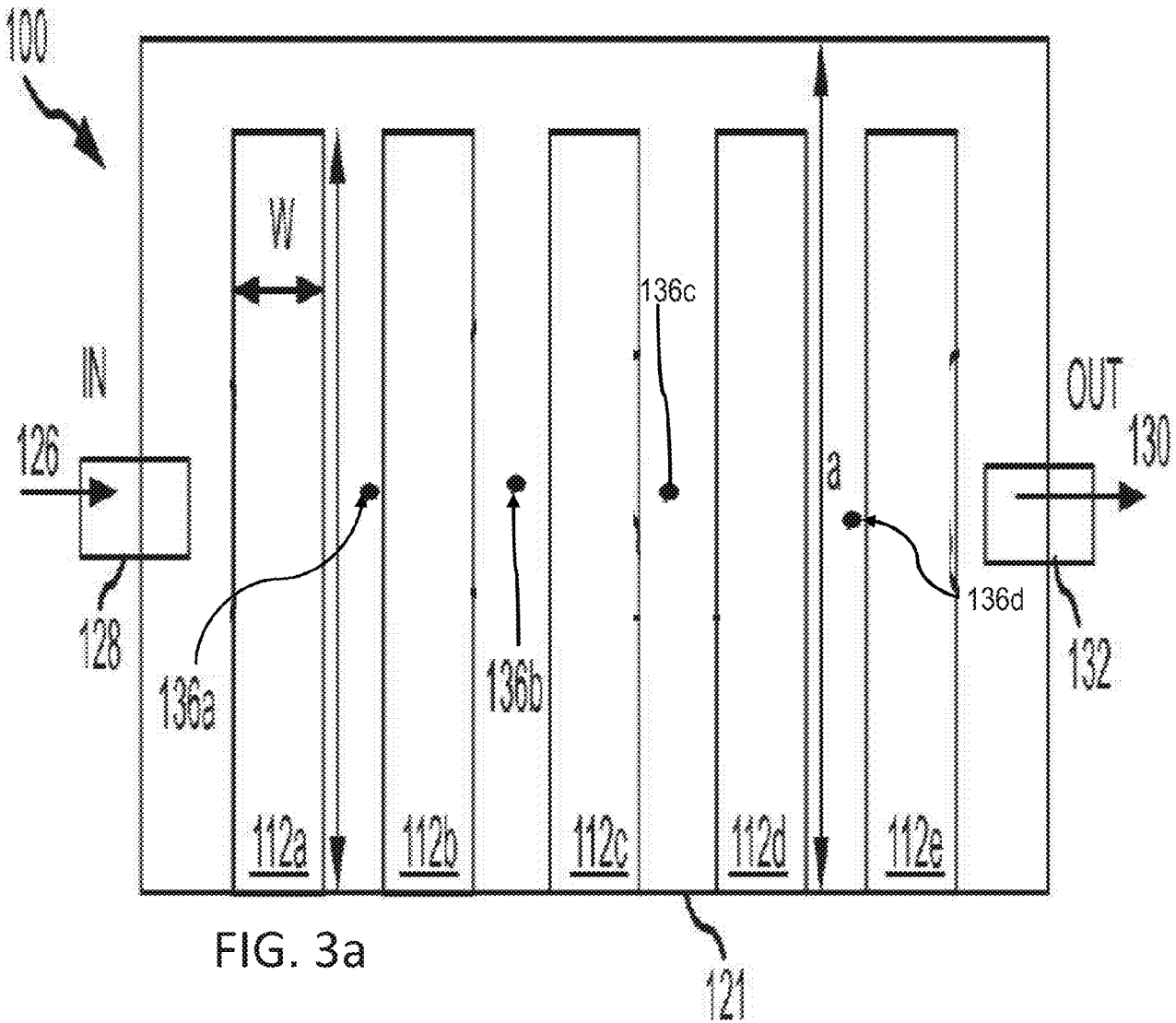
FIGS. 3*a* to 3*c* are plan, end and side views of an exemplary 5-pole planar parallel-coupled stripline band-pass filter, according to some embodiments of the present invention.
Figure 3B:
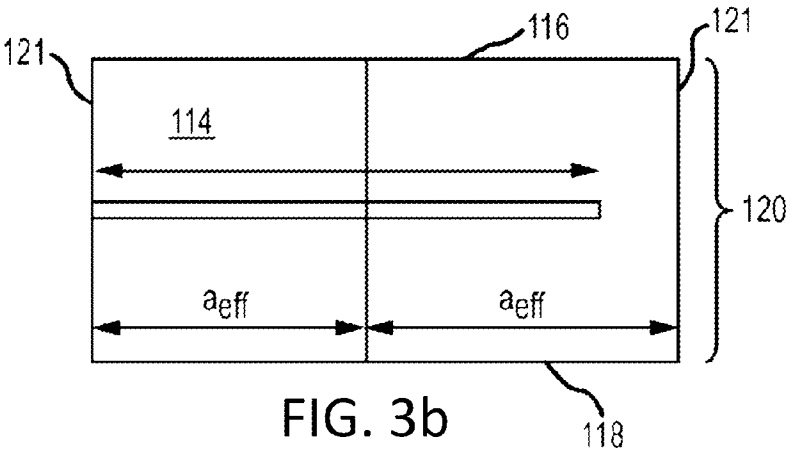
Figure 3C:
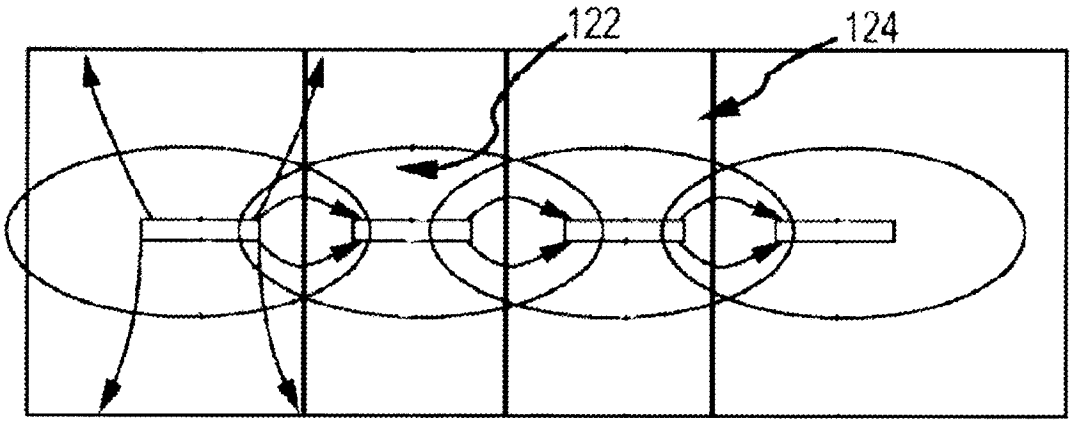

FIGS. 3*a* to 3*c* depict plan, end and side views of an exemplary 5-pole planar parallel-coupled stripline band-pass filter, according to some embodiments of the present invention. As shown, a 5-pole stripline band-pass filter includes parallel-coupled ¼λ planar resonators that are grounded at one end and open at the other and including conductive structures between adjacent resonators, in accordance with some embodiments of the invention.

Five planar resonators 112*a* through 112*e* lie in a dielectric layer 114 (air or other dielectric material) equally spaced between an upper ground plane 116 and a lower ground plane 118 that define a cavity 120. In these embodiments, each resonator has a length "l" and a width w". The length "l" generally determines the center frequency of the filter and the width "w" (and thickness) generally determine the impedance. The resonators are connected to ground at one end to a side ground plane 121 and open at the other end. Another side ground plane 121 is suitably formed on the other side of the cavity opposite the open end of the resonators. All of the ground planes are in electrical contact held at a single ground.

The cavity has a width "a" which is the resonator length "l" plus any additional unoccupied space and a spacing "s" which is the center-to-center spacing of the resonators. This spacing generally determines coupling of the electric field E 122 and magnetic field M 124 between resonators (shown in FIG. 3*c*). An electromagnetic wave 126 is coupled into the filter via an input port 128 and is parallel-coupled from one resonator to the next and is coupled out of the filter as filtered wave 130 via an output port 132. The propagation of the wave from one resonator to the next resonator filters the wave according to the designed filter response (e.g. low-pass, high-pass, band-pass or band-stop). For example, this particular 5-pole design imparts a band pass response to the wave.

Conductive vias 136*a*, 136*b*, 136*c*, and 136*d* are formed between all or some of the adjacent resonators, substantially normal to resonators 112*a*, 112*b*, 112*c*, 112*d* and 112*e*, respectively. Conductive vias 136*a*, 136*b*, 136*c*, and 136*d* are terminated at the upper and lower ground planes 116 and 118, respectively. Alternately, the vias could extend through and beyond the ground planes by ¼λ to create virtual grounds at the walls of the cavity. In the case of a single via per two adjacent resonators, the vias may suitably be placed at the midpoint of the cavity and the spacing between the two adjacent resonators. For the waveguide as a whole and for non-adjacent resonators this effectively cuts the width of the cavity in half so that roughly aeff is approximately equal to (½)*a. The vias reduce the coupling between non-adjacent resonators as well as adjacent resonators. Reducing the coupling between non-adjacent resonators is desirable. Reducing coupling between adjacent resonators is not desirable but can be corrected by reducing the spacing s between adjacent resonators.

In a microstrip filter, the resonators 112*a*, 112*b*, 112*c*, 112*d* and 112*e* and lower ground plane 118 may be formed on opposite sides of a dielectric substrate. The upper ground plane 116 is placed at a much greater distance above the resonators so that it is not part of the transmission line. The upper ground plane may, for example, be a conductive lid for a filter package that is connected to the lower ground plane. The vias 136*a*, 136*b*, 136*c*, and 136*d* may be terminated at the upper and lower ground planes. In some embodiments, the vias might be screws or pieces of metal or wire (and the like) that are inserted into the filter structure.

Figure 4:
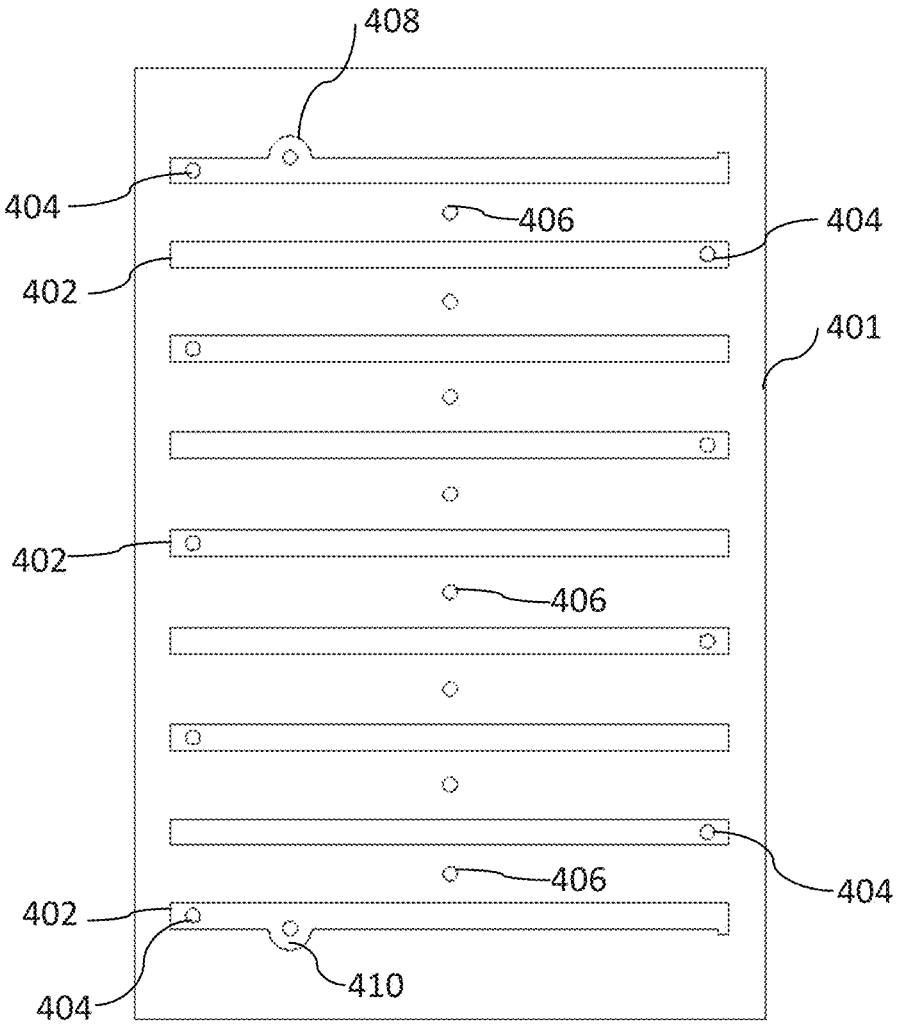
FIG. 4 illustrates an exemplary coupled resonator filter with one row of conductive structures between the resonators, according to some embodiments of the present invention.

FIG. 4 illustrates an exemplary coupled resonator filter with one row of conductive structures between the resonators, according to some embodiments of the present invention. As shown, nine resonators 402 are formed in a cavity 401 in parallel. Each of the resonators 402 is grounded at one end by a conductive structure 404, such as a via. Additionally, eight conductive structures 406, such as vias, are formed between the nine resonators 402, in a single row formation. The placement of conductive structures 406 can be anywhere between resonators 402 and will improve the input-to-output isolation between input port 408 and output port 410. An electromagnetic wave is coupled into the filter via an input port 408 and is parallel-coupled from one resonator to the next and is coupled out of the filter as a filtered wave via an output port 410.

Figure 5:
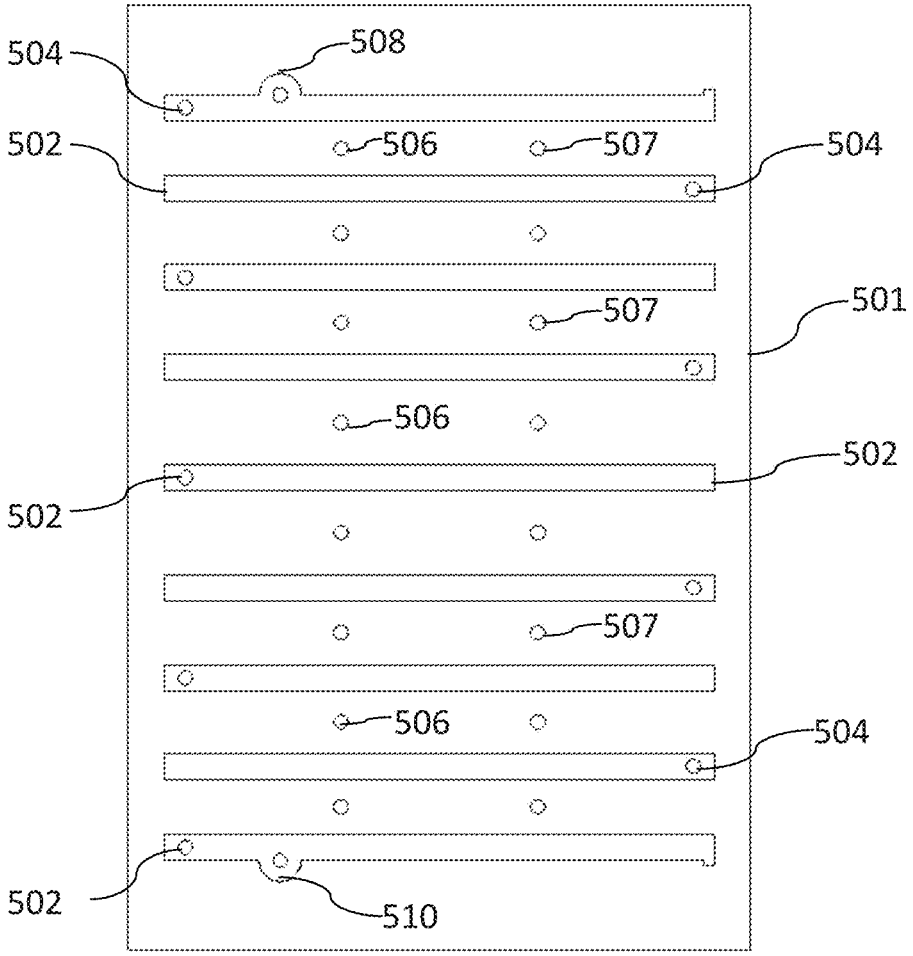
FIG. 5 depicts an exemplary coupled resonator filter with two rows of conductive structures between the resonators, according to some embodiments of the present invention.

FIG. 5 depicts an exemplary coupled resonator filter with two rows of conductive structures between the resonators, according to some embodiments of the present invention. In this example too, nine resonators 502 are formed in a cavity 501 in parallel. Each of the resonators 502 is grounded at one end by a conductive structure 504, such as a via. Also, eight conductive structures 506, such as vias, are formed between the nine resonators 402, in a first row formation. Additionally eight conductive structures 507, such as vias, are also formed between the nine resonators 402, in a second row formation. The placement of conductive structures 506 and 507 is flexible and either via can be placed anywhere in between resonators 502 and will improve the input-to-output isolation between input port 508 and output port 510. An electromagnetic wave is coupled into the filter via an input port 508 and is parallel-coupled from one resonator to the next and is coupled out of the filter as a filtered wave via an output port 510.

Although FIGS. 4 and 5 show a single-row and a two-row conductive structures between the resonators, those skilled in the art would readily understand that the present invention is not limited to one or two rows of conductive structure. Rather, other number of rows or other non-row arrangements of the conductive structures are also within the scope of the invention. The number of vias between resonators reduces the coupling and will eventually be impossible to correct by bringing the resonators closer.

Figure 6:
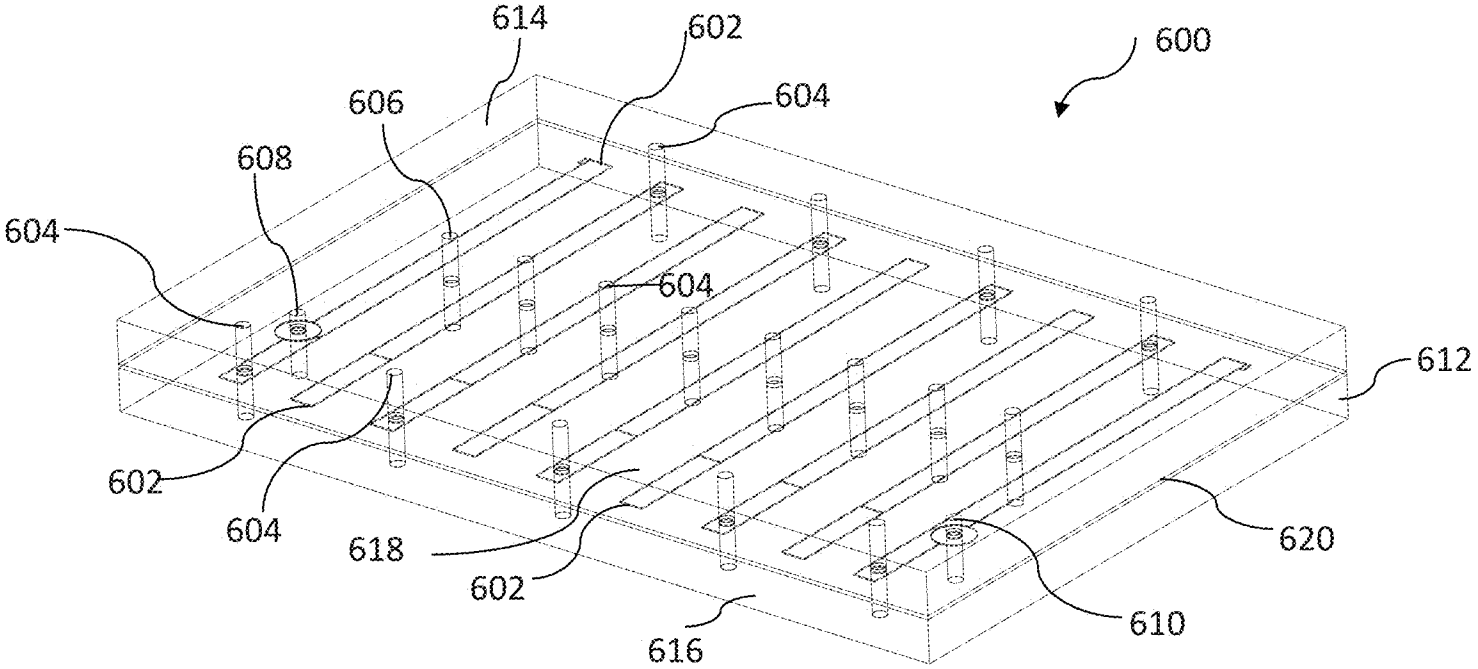
FIG. 6 shows a perspective view of a 9-pole folded parallel-coupled stripline band-pass filter including both vertical via and horizontal strip ground structures, according to some embodiments of the present invention.

FIG. 6 shows a perspective view of a 9-pole folded parallel-coupled stripline band-pass filter including both vertical via and horizontal strip ground structures, according to some embodiments of the present invention. As shown, a 9-pole stripline band-pass filter 600 includes nine parallel and electromagnetically coupled ¼λ folded resonators 602 that are grounded at one end by conductive structures 604 and open at the other. As arranged, the resonators 602 alternate which end is terminated at top ground plane 614 and bottom ground plane 616.

Filter 600 further includes upper and lower ground planes 614 and 616 on top and bottom surfaces of a cavity 618 and side ground planes 612 on opposing sides of the cavity. The upper, lower and side ground planes are in electrical contact held, for example, at a single ground. Nine parallel-coupled folded resonators 602 in the cavity between and normal to the upper and lower ground planes define respective transmission lines. An input port 608 is coupled to a first resonator to receive an EM wave and an output port 610 is coupled to a last resonator to output a filtered EM wave. Conductive structure (e.g., vias) 606 pass through between adjacent resonators and are terminated at one or more of the upper and lower ground planes. This configuration reduces the coupling between the input port and the output port and thus improves filter response, as shown in FIG. 7, using simulation results.

Figure 7:
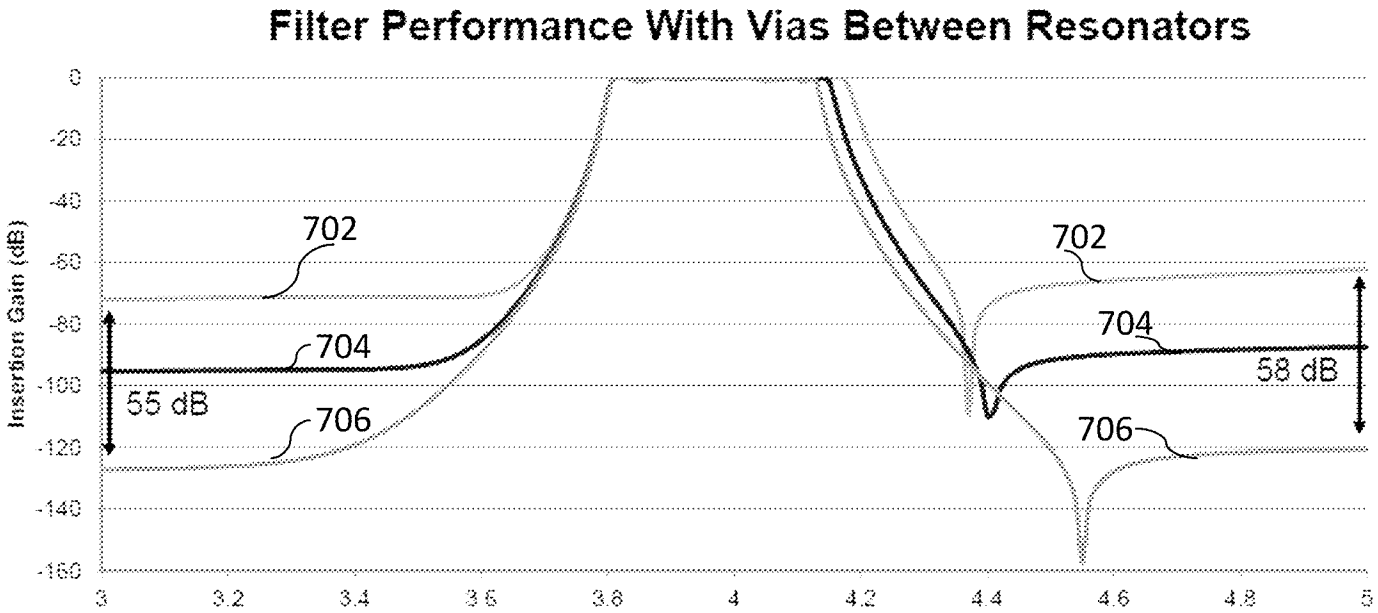
FIG. 7 is a plot of filter performances with no vias, one via, and two vias between resonators.

FIG. 7 is a plot of filter performance with no vias, one via, and two vias between resonators. Three plots for filter insertion gain over frequency are shown. Plot 702 is for a filter with no vias in between the resonators, plot 704 is for a filter with one row of vias in between the resonators, and plot 706 is for a filter with two rows of vias in between the resonators. As depicted, the (one or two rows of) vias between the coupled resonators greatly improve the ultimate filter rejection. For example, there is a 55 dB improvement on the filter rejection between plot 702 (no vias) and plot 706 (two rows of vias) at 3 GHz and a 58 dB improvement at 5 GHz. However, as explained above, the bandwidth of the filter is reduced due to reduction of the coupling between the adjacent resonators. Nevertheless, this can be compensated by moving the resonators closer to each other, which also decreases the overall size of the filter.

It will be recognized by those skilled in the art that various modifications may be made to the illustrated and other embodiments of the invention described above, without departing from the broad inventive step thereof. It will be understood therefore that the invention is not limited to the particular embodiments or arrangements disclosed, but is rather intended to cover any changes, adaptations or modifications which are within the scope of the invention as defined by the appended claims.

What is claimed is:

1. A distributed electromagnetic (EM) wave filter comprising:

a cavity;

a single upper and a single lower ground plane on top and bottom surfaces of the cavity respectively, wherein the single upper and single lower ground planes are in electrical contact;

a plurality of electromagnetically coupled resonators in said cavity between the single upper and single lower ground planes that define respective transmission lines, wherein the plurality of resonators are not connected to each other by a conductive connection;

an input port coupled to a first one of the plurality of resonators to receive an EM wave;

an output port coupled to a last one of the plurality of resonators to output a filtered EM wave; and a plurality of conductive structures between some of adjacent resonators of the plurality of resonators, respectively and connected to one or more of the single upper and single lower ground planes, wherein the plurality of conductive structures between some of adjacent resonators are formed in multiple rows.

2. The distributed EM wave filter of claim 1, wherein the plurality of conductive structures are placed between all of the adjacent resonators.

3. The distributed EM wave filter of claim 1, wherein each of the plurality of resonators is a folded resonator normal to the single upper and single lower ground planes.

4. The distributed EM wave filter of claim 1, wherein the plurality of conductive structures are via contacts.

5. The distributed EM wave filter of claim 1, wherein the plurality of conductive structures are screws or pieces of wire.

6. The distributed EM wave filter of claim 1, wherein the plurality of resonators are spaced apart from said single lower ground plane to define a micro-strip transmission line.

7. The distributed EM wave filter of claim 1, wherein the plurality of resonators are approximately equidistant from said single upper and single lower ground planes within a dielectric media of uniform dielectric constant to define a stripline transmission line.

8. The distributed EM wave filter of claim 1, wherein each of the plurality of conductive structures is connected to one or more of the single upper and single lower ground planes at one end thereof.

9. The distributed EM wave filter of claim 1, wherein each of the plurality of conductive structures is connected to one or more of the single upper and single lower ground planes at both ends thereof.

10. The distributed EM wave filter of claim 1, wherein each of the plurality of conductive structures comprises a conductive via contact connected at opposite ends to said single upper and single lower ground planes.

11. The distributed EM wave filter of claim 1, wherein each of the plurality of resonators is a planar resonator parallel to the single upper and single lower ground planes.

* * * * *